United States Patent [19]

Rocchitelli

[11] Patent Number: 4,988,132

[45] Date of Patent: Jan. 29, 1991

[54] DOORLATCH, IN PARTICULAR FOR WASHING MACHINES

[76] Inventor: Onofrio Rocchitelli, Via per Lainate, 31- I 20010 Pogliano Milanese, Italy

[21] Appl. No.: 381,679

[22] PCT Filed: Jan. 6, 1988

[86] PCT No.: PCT/EP88/00013

§ 371 Date: Jul. 7, 1989

§ 102(e) Date: Jul. 7, 1989

[87] PCT Pub. No.: WO88/05476

PCT Pub. Date: Jul. 28, 1988

[51] Int. Cl.[5] ..... E05C 13/10

[52] U.S. Cl. ..... 292/144; 292/DIG. 69; 292/DIG. 66

[58] Field of Search ..... 292/DIG. 69, 201, 144, 292/DIG. 61, DIG. 66

[56] References Cited

U.S. PATENT DOCUMENTS 4,516,007 5/1985 Ringdahl et al. ..... 292/DIG. 69 X 4,717,794 1/1988 Paul et al. ..... 292/DIG. 69 X

FOREIGN PATENT DOCUMENTS 2477620 11/1981 France .

*Primary Examiner*—Richard E. Moore

*Attorney, Agent, or Firm*—Parmelee, Bollinger & Bramblett

[57] ABSTRACT

Apparatus for rapid locking and delayed unlocking of the door closing mechanisms of machines such as washing machines with internal parts which are subject to inertial rotation. A sliding bar (15) is engaged by the hook (100) of the door-latch and is locked during the rotational part of the cycle by a pin (21) actuated by the mobile contact plate (8) of a microswitch through a rocker arm (6) moved by a bimetallic strip (2) suitably heated by a resistor electrically connected to the starting controls of the machine. The mobile contact plate (8) of the microswitch is subjected to the load of an eccentric ratchet (12) to control the insertion time and delayed opening of the door-lock. The bimetallic strip (2), heating resistor (5), and the rocker arm (6) rest one on another to assure that the curving and straightening times of the bimetallic strip (2) remain stable through time.

4 Claims, 3 Drawing Sheets

DOORLATCH, IN PARTICULAR FOR WASHING MACHINES

BACKGROUND OF THE INVENTION

It is well-known that washing machines must be equipped with devices which can lock the door closing mechanism when the machine is started up and then unlock them with a certain delay after the current has switched off, in order to ensure that the door cannot be opened while some of the components are still rotating inertially (in particular the drum of the spin-dryer).

Some types of these devices exist in which the closing and delayed opening is obtained by means of the use of a bi-metal and the time this takes to cool. There are other types of devices, some of them of the same inventor, which carry out the aforesaid functions by other means: magnetic, wax actuated thermostats etc.

It is also known from French Pat. No. FR-A-2 477 620 to actuate a locking pin that with its movement locks the door closure latch, by using the motion of the mobile contact of a microswitch, wherein the support of the mobile contact is made of two half pieces joined by a spring and is actuated by two opposite and curved bi-metallic elements.

With such a system because of the instrinsic characteristics of the springs, said spring does not maintain its initial calibration so that connection and delay times vary with time and use. Furthermore, the calibration system of said patent, obtained by acting on the first half part of the support of the mobile contact, does not allow a sufficient calibration precision.

Finally, the presence in said patent of two opposite bi-metallic elements, in addition to doubling possibilities of errors, in particular conditions after a number of consecutive actuations, causes a kind of balance of the opposite forces, with the consequence of an insufficient thrust on the support of the mobile contact during actuation, so as to cause false contacts or lack of contact, and consequently said contacts stick together or burn out.

Furthermore a device is shown in EP-A-0 092 162 constituted by a sliding bar, working together with the hook of the door latch associated with a pin suitable for locking the aforesaid sliding bar under certain pre-set conditions, wherein the locking pin is actuated by the mobile contact plate of a microswitch, having also the funciton of a series switch, wherein the mobile contact of the microswitch is actuated by a single bi-metallic strip suitably heated and electrically connected to the controls of the machine, and wherein the heating means of the bi-metallic strip is constituted by a P.T.C.-resistance.

With this system the bi-metallic strip is fixed at one end to the mobile contact plate of the microswitch and acts on the mobile contact through a spring. Thus while it works well it does not maintain a sufficient calibration precision through time and there is also a certain difficulty involved in mounting the spring which connects the bi-metallic strip to the mobile contact plate.

The object of the present invention is to provide a door-locking device which gives ample guarantees of safety, locking the door before the washing machine is in motion, maintaining this lock during the time the machine is operating up to the time the current is interrupted and beyond this until every rotating part has stopped.

A further characteristic of the invention is that the door-locking device is equipped with an extremely simple and effective device which regulates the opening time.

Another characteristic of the invention is the arrangement of its components which makes it possible to construct and mount the body of the device and subsequently add to it the eyelet sliding bar into which the hook of the door-latch and the coupling flange of the washing machine fit. These details vary from manufacturer to manufacturer, therefore the same basic standard device can be used for the most varied types of machines simply by changing these two specific details (sliding bar and coupling flange).

Finally, it has been designed in such a way that the basic body of the door-locking device can, when requested, be connected up to a device which contains the controls of the moving parts of the machine during the washing stage, or to the drying controls if the machine also functions as a dryer, so that the door is not locked during these sequences of the cycle.

The apparatus according to this invention is basically constituted by a sliding bar, working together with the hook of the door closing mechanism, said sliding bar being combined with a pin which locks the aforesaid sliding bar under certain specific conditions, wherein the locking pin is actuated by the mobile contact plate of a microswitch, having the function of a series switch, and the mobile contact means of the microswitch is actuated by a single bi-metallic strip, suitably heated by a P.T.L. resistance electrically connected to the starting controls of the machine, characterized in that the mobile contact of the microswitch is actuated by means of a rocker arm interposed between the bimetallic strip and the mobile contact of the microswitch; and the appropriate part of the contact plate of the microswitch is, in its turn, subjected to the load of an eccentric ratchet; said load having the function, by increasing or decreasing, of altering the insertion time and the delayed opening of the door-lock as a function of the possible variations of the time of bending and straightening of the bi-metallic strip during the heating and cooling of the bimetal and the related heating equipment, variations which can occur even between materials of the same lot, and the bimetallic strip simply rests on supports located at each end and the P.T.C. resistance rests on it, just the rocker arm 6 rests on the P.T.C. resistance thus ensuring that the curvature and straightening times remain certain through time. The invention will become clearer if reference is made to the example of an embodiment, an example which is indicative and non-limiting, in the three drawings attached.

DESCRIPTION OF A PREFERRED EMBODIMENT

Figure 1:
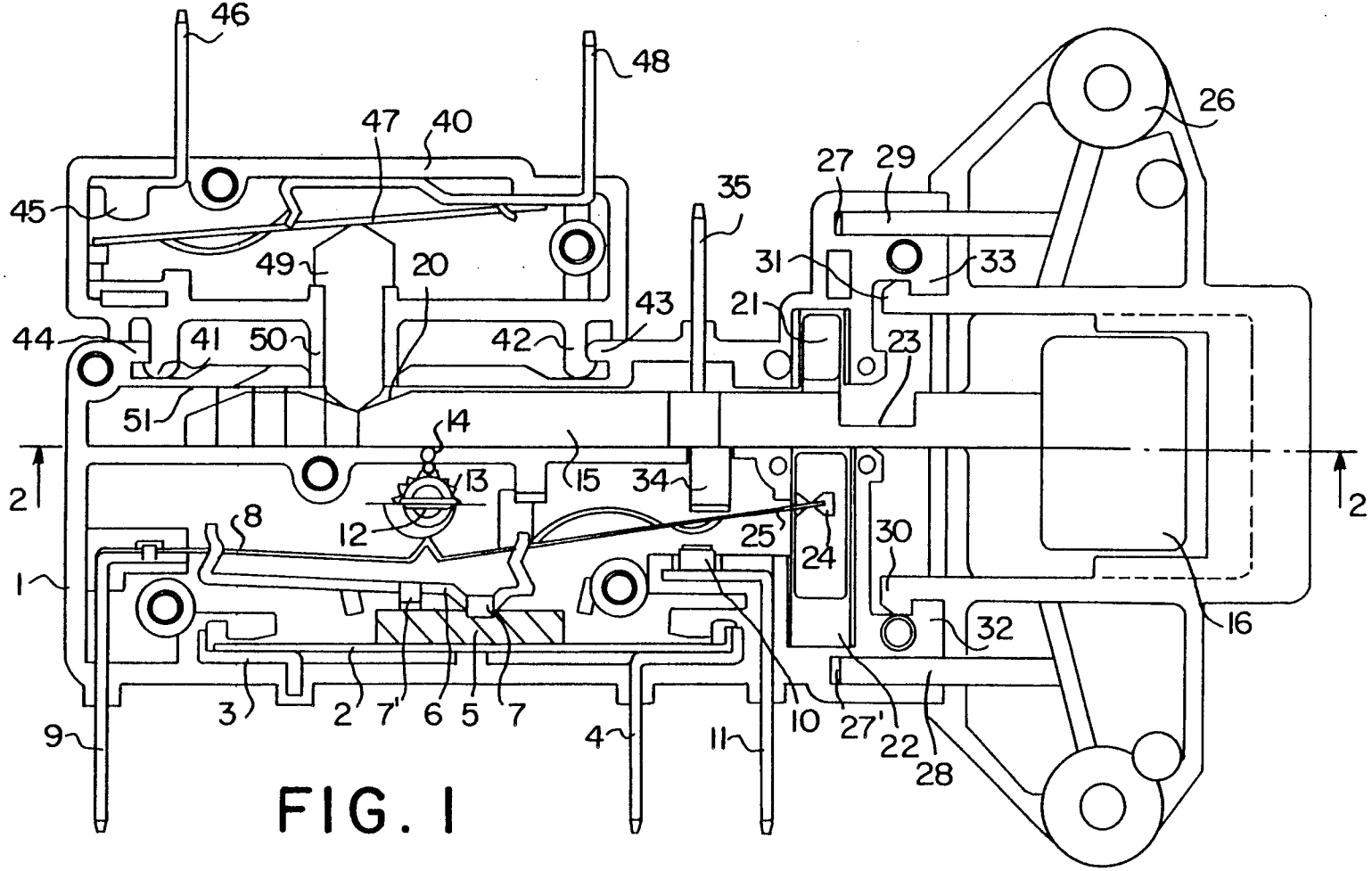
FIG. 1 represents the device at rest, i.e a cross-section with the door open.

Referring to FIGS. 1, 2, 3 and 4, the device according to the invention is constituted by a boxed body 1 generally moulded in thermoplastic material, acting as a housing for the various components of the device, consisting of:

a bi-metallic strip 2 resting on supports 3 and 4 made of electrically conducting materials, support 4 projecting outside the housing in the form of a connection male contact.

a P.T.C resistance 5, resting with one face on the bi-metallic strip in such a way as also to constitute an electrical contact having, when heated, the function of supplying the heat required for the deformation of the bi-metallic strip;

a rocker arm 6 made of electrically conducting material, resting on the other face of the P.T.C resistance so as to provide another electrical contact, held in position laterally by supports 7 and 7' and acting on the mobile contact plate of a microswitch by means of its upper arms;

a microswitch constituted by a mobile contact plate 8 connected to the connection male contact 9 and connected to a connection male contact 11 by means of a fixed contact 10.

an eccentric cylindrical component 12 with a toothed section 13 which can mesh with the pawl 14;

a sliding bar 15 terminating outside the box 1 in an eyelet 16 into which the hook of the door-latch 100 is inserted when the door is closed.

A longitudinal cut has been made in the rear half of this sliding bar, opposite the eyelet, (see FIGS. 2 and 4) in a manner known per se (see EP-A-0 092 162) and, therefore, the bar 15 is divided into two arms which come together and separate elastically because of the characteristics of the material from which they have been made—thermoplastic resin. These arms have two series of lateral notches 17 and 17', 18 and 18' which can engage with the wedges 19 and 19' cut into the body of box 1. This arrangement of the aforesaid part is designed to avoid the use of springs to keep the sliding bar 15 in the correct position, both during opening and when locking, in a manner known per se from EP-A-0 092 162.

Figure 3:
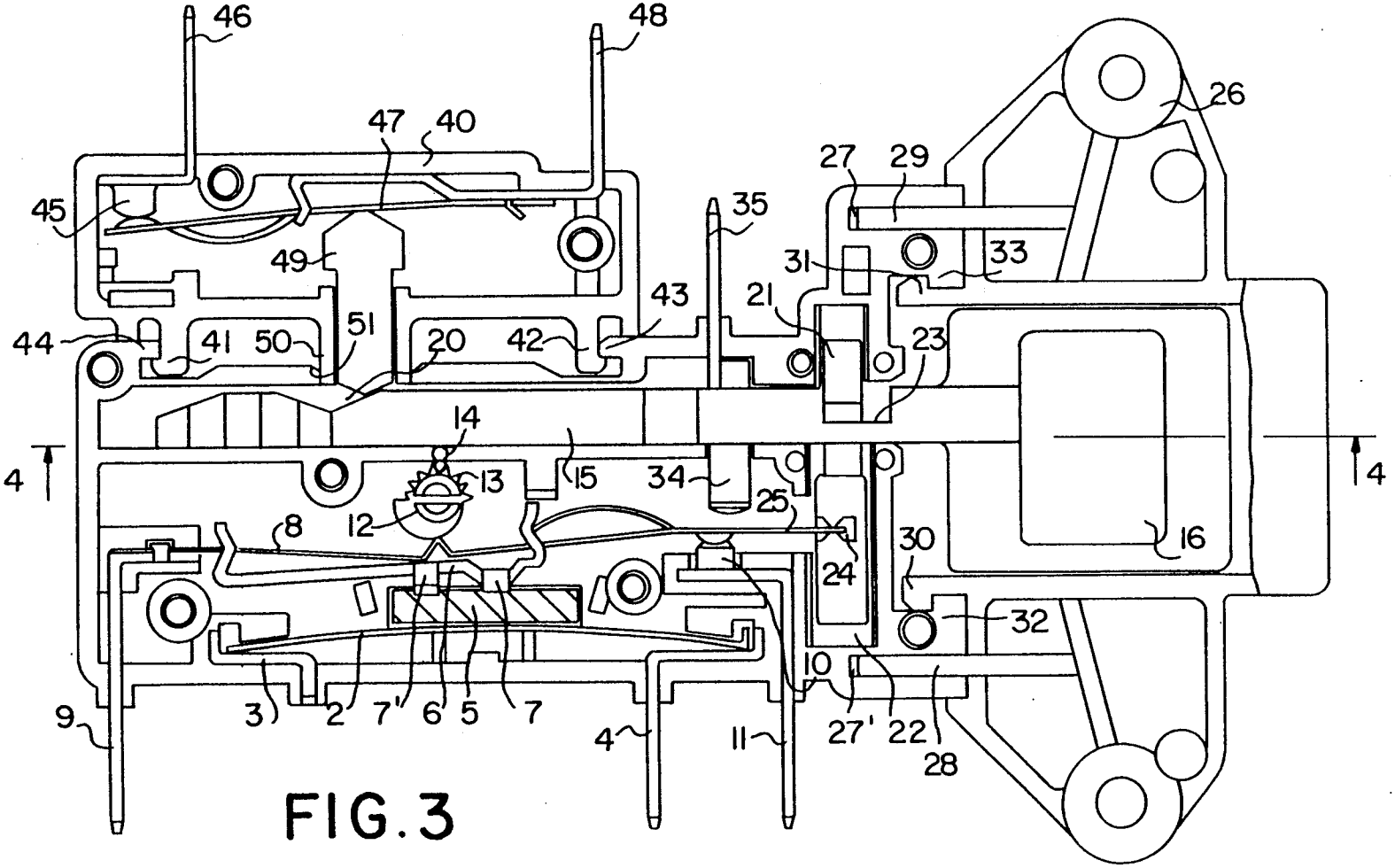
FIG. 3 represents the device in the locked position, i.e a cross-section with the door closed.

As can be seen in FIGS. 1 and 3, the upper side of the sliding bar 15 has another wedge 20 which, as will be explained later, is used for the functioning of the machine controls when the door is unlocked.

The sliding bar 15 can be mounted from outside with the door-latch coupled and is already complete with all its components, so that sliding bar 15 with an eyelet 16 of the appropriate shape and size of the particular make of machine in question can be mounted;

a locking pin 21 running in a housing 22, the upper part of which locks into a cavity 23 in the sliding bar 15 during the locking stage.

The lower part of the locking pin 21 has an aperture 24 which accepts the extension 25 of the mobile contact plate 8 of the microswitch. As said plate is made of a single piece of elastic material it is fixed at the end opposite the contact end.

a flange 26 which couples the device to the machine of the appropriate form and size for the particular type and make of machine in question. As has already been said, this component is not moulded in a single piece with the body 1, but constitutes an additional interchangeable component.

To implement this, two slots 27 and 27' have been provided in the body 1, to which can be coupled two arms 28 and 29 protruding from the flange 26 which is also provided with clutch jaws 30 and 31 which couple to two protrusions 32 and 33 contained within the box 1.

The device is completed by contact 34 connected to a connection male contact 35 which provides the power for an indicator light which remains lit when the door-lock is not inserted. The door-locking device is electrically connected in series on the phase of the operating current of the machine. Therefore, while one of the supply phases goes directly to the working controls of the machine, the second phase enters through the quick-action contact 9 and passes to the working controls through the connection male contact 11 with the microswitch 8–11 interposed.

The connection male contact is provided for the connection of the first phase of the electricity supply to the P.T.C resistance 5.

The device functions in the following way. At rest, the various components are in the positions shown in FIGS. 1 and 2 i.e. microswitch 8–11 open; bi-metallic strip 2 in a flat position; sliding bar 15 with eyelet moved forward, in an axis with the hook 100 of the closing latch of the door, this position of the sliding bar 15 (see FIG. 2) being guaranteed by the locking of the wedges 19, 19' into the notches 17 and 17' of the elastic tail of the bar 15.

Figure 2:
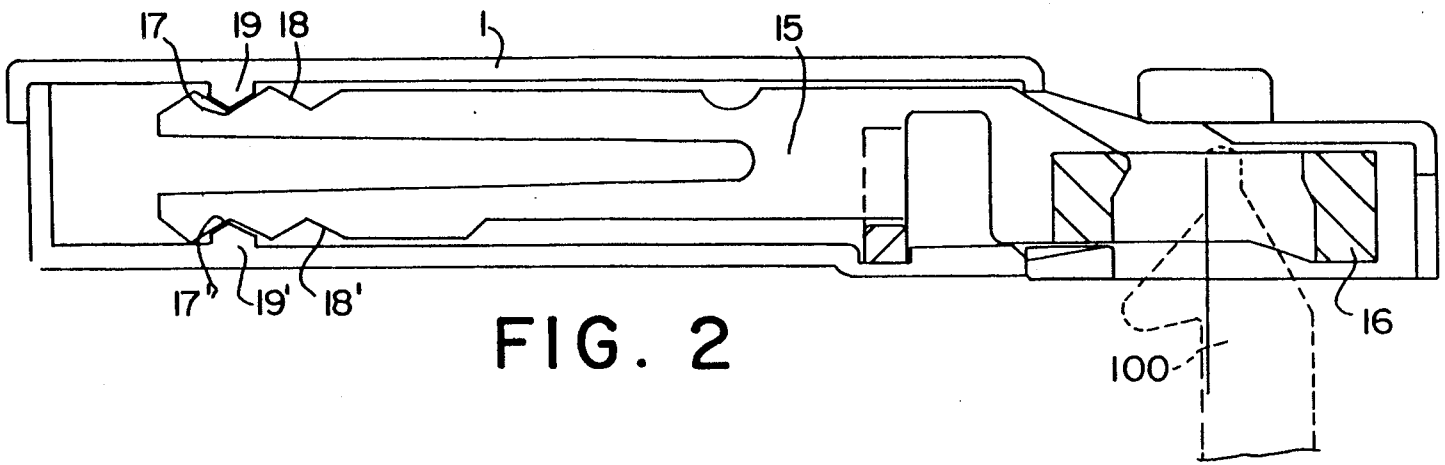
FIG. 2 is a view of A—A in FIG. 1 of the sliding bar which locks the hook of the door-latch.
Figure 4:
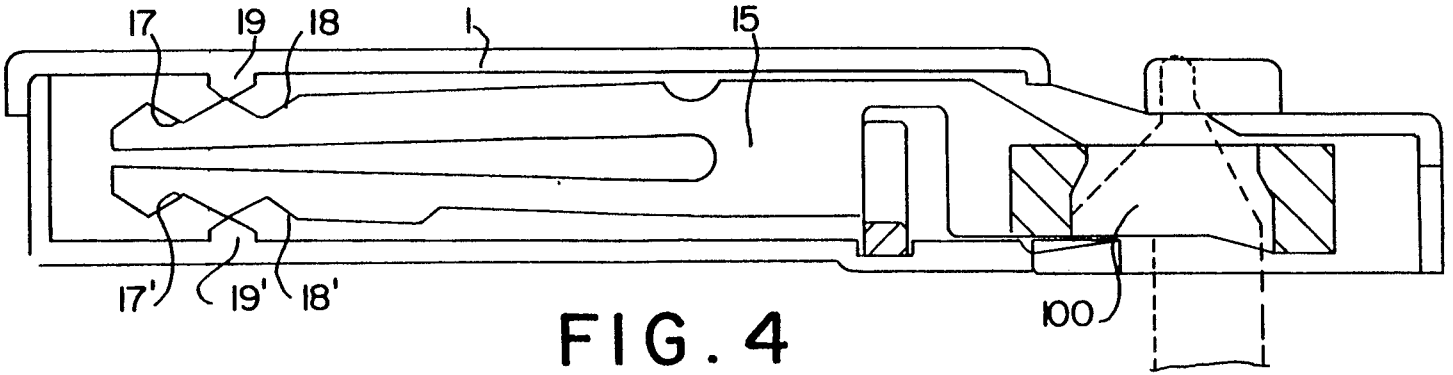
FIG. 4 is a view of B—B in FIG. 3 of the sliding bar which locks the hook of the door-latch.

When the user closes the door (see FIG. 4) the hook 100 of the door latch engages with the eyelet 16 and closes, thus pushing the sliding bar 15 backwards from the position shown in FIG. 2 to the position shown in FIG. 4 (To be absolutely accurate, FIG. 4 shows a transition stage of the movement of the sliding bar from the open position to the closed position). The bar 15 stops with the wedges 19 and 19' locked into notches 18 and 18' and with the cavity 23 in axis with the pin 21.

At this point the user starts up the machine and the current flows through the connection male contact 9, the mobile contact plate 8, the rocker arm 6, all the electrically conducting material on one side and, through connection male contact 4, supplies the P.T.C resistance which heats up almost instantaneously and transmits its heat to the bi-metallic strip 2, causing it to arch out and thus raise rocker arm 6. The rocker arm 6 acts on the mobile contact plate 8 of the microswitch, pressing it downwards to close the circuit and thus provide power to the working parts of the machine and, at the same time, lowers the pin 21 so that its upper part can insert itself into the cavity 23 of the sliding bar 15, blocking the bar 15 for as long as these conditions last and, as a consequence, locking the hook 100 of the door latch of the machine in the eyelet 16.

When the machine has completed its working cycle and the current is interrupted, the P.T.C resistance cools down, the bi-metallic strip returns to the position in FIG. 1 and, therefore, the mobile contact plate 8 moves in the opposite direction, reopening the circuit and, at the same time, raising the pin 21 which withdraws from the aperture 23 of the sliding bar 15, freeing it and thus permitting the door to open.

During the opening operation, the hook 100 of the door latch moves from the position shown in FIG. 3 to the position shown in FIG. 1, pulling out the locking bolt and moving it from the position shown in FIGS. 1 and 3 to the position shown in FIGS. 2 and 4.

All this does not happen immediately but after a certain lapse of time, approximately 60 seconds. This delay is caused by the time required for the combination of the P.T.C resistance 5 and bi-metallic strip 2 to cool down, such time being largely predetermined by the characteristics of the bi-metallic strip and the P.T.C resistance but, according to this invention, being capable of adjustment by adjusting the pressure on the mobile contact plate 8 by means of the eccentric ratchet 12 which can be rotated to achieve the delay required, such position remaining constant by means of the hold of the pawl 14 on the teeth 13.

An optional device is now described whose function is to permit the machine to operate even if the door is not locked. This device can be used in machines which have the possibility of opening the door during the washing cycle and, therefore, the door-locking device is energised only during the spin-drying cycle when the drum is rotating very fast and/or in those machines which have a hot-drying cycle.

The device consists of a box 40 with external couplings 41 and 42 which are firmly mounted on the protrusions 43 and 44 provided on the outside of the box 1 of the door-locking device. The box 40 contains a microswitch constituted by a fixed contact 45 which has an external intension with connection male contact 48 and push-button 49 which acts on the mobile contact plate 47.

The push-button 49 runs inside a hollow cylindrical housing 50 and, therefore, it can be outside the box 40. In correspondence, the box 1 of the door-locking device has a hole 51 which accepts the aforesaid hollow cylindrical housing 50 so that the push-button 49 can penetrate into box 1 and come into contact with the sliding bar 15 of the door-locking device.

As has already been said, the sliding bar 15 has a notch 20. When at rest, with the machine off and the door open, the push-button 49 descends to rest on this and, in this position, the microswitch opens contacts 45–47 as can be seen in FIG. 1. When the door is closed, as in FIG. 3, the rod 15, draws back because of the thrust exercised on its eyelet 16 by the hook 100 of the door-latch, (see FIG. 3) and moves the push-button 49 upwards, closing the circuit. Thus the second phase of the supply current of the working parts of the machine can flow through contacts 46, 45, 47, 48 in spite of the fact that the door-locking device is operating, and in this condition the door can be opened during working, and this door opening re-opens contacts 45–47 and stops the working parts.

Obviously, this can only happen during the washing and/or drying cycles in which the second phase of the current is supplied by the program to the working parts of the machine through connection male contacts 46–48 while, during the spin-drying cycle which involves high speed rotation of the drum and inertial rotation, the second phase of the current is fed to the working parts of the machine through the connection male contacts 9–11.

I claim:

1. For use in effecting rapid locking and delayed unlocking of door-closing mechanisms of machines such as washing machines which have internal parts subject to inertial rotation;

apparatus of the type comprising a sliding bar (15) engageable with hook means (100) of the door latch and including locking pin means (21) suitable for locking said sliding bar (15) during the rotational part of the machine cycle, said locking pin means (21) being actuatable by the mobile contact means (8) of a microswitch functioning as a power switch for the machine, said mobile contact means of the microswitch being shiftable by means driven by a single bimetallic strip (2) suitably heated by a P.C.T. resistance electrically connected to the power circuit of the machine;

the improvement to said apparatus comprising:

a rocker arm (6) interposed between said bimetallic strip (2) and the mobile contact means (8) of said microswitch;

means (12) engaging said mobile contact means (8) of said microswitch for increasing or decreasing the load thereon to adjust the time required for curvature and straightening movement of said bimetallic strip during its heating and cooling stages;

supports (3 and 4) for said bimetallic strip (2);

said heating resistance being in contact with said bimetallic strip to be moved thereby; and said rocker arm (6) being in contact with said resistance;

whereby the curvature and straightening times of said bimetallic strip remain constant over time.

2. Apparatus according to claim 1, comprising a mounting flange (26) for coupling said apparatus to the machine; said mounting flange being constructed as an element separate from said apparatus whereby a different size and configuration of the flange may be selected and installed according to the type and make of machine on which the apparatus is to be mounted; said flange being formed so as to be connectable to the frame (body 1) of said apparatus; said frame being formed with slots (27 and 28) and protuberances (32 and 33) to effect coupling with said flange.

3. Apparatus according to claim 1, wherein said sliding bar (15) is formed with an eyelet (16) shaped and sized to receive the door-lock hook of the machine on which the apparatus is to be mounted, thereby providing for insertion of the apparatus into the finished door-lock simply from outside.

4. Apparatus according to claim 1, further comprising a device permitting the machine to function during certain sequences of the working cycle when the rotational parts rotate slowly, without locking the door-closing mechanism, said device comprising a box (40) connectable by couplings (41 and 42) engageable with cooperating means (43 and 44) provided on the outside of the frame (body 1) of said door-locking apparatus, and including a second microswitch activatable by means of a push-button (49) which acts on the mobile contact plate (47) of said second microswitch and is housed in means (50) so that it can protrude outside the device box (40), said housing means being insertable through the frame (1) of said door-locking apparatus so that the push-button (49) can come into contact with the sliding bar (15) of the door-locking apparatus, said bar being formed with a notch (20) in position for receiving one end of said push-button when the sliding bar is in the off position and the door can be opened and the machine is stopped with power interrupted by the second microswitch, the sliding bar (15), pushed by the hook (100) of the door latch of the machine, operating the push-button (49) to close said second microswitch.

* * * * *